US011664134B2

(12) United States Patent
Sakaida et al.

(10) Patent No.: US 11,664,134 B2
(45) Date of Patent: May 30, 2023

(54) ALUMINUM BASE WIRE, STRANDED WIRE, AND METHOD FOR MANUFACTURING ALUMINUM BASE WIRE

(71) Applicant: SUMITOMO ELECTRIC INDUSTRIES, LTD., Osaka (JP)

(72) Inventors: Hideaki Sakaida, Osaka (JP); Akihisa Hosoe, Osaka (JP); Yusuke Kureishi, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 117 days.

(21) Appl. No.: 17/431,904

(22) PCT Filed: Apr. 3, 2020

(86) PCT No.: PCT/JP2020/015418
§ 371 (c)(1),
(2) Date: Aug. 18, 2021

(87) PCT Pub. No.: WO2020/217937
PCT Pub. Date: Oct. 29, 2020

(65) Prior Publication Data

US 2022/0148756 A1 May 12, 2022

(30) Foreign Application Priority Data

Apr. 26, 2019 (JP) ..... JP2019-086664

(51) Int. Cl.
*H01B 5/02* (2006.01)
*C22C 21/00* (2006.01)
(Continued)

(52) U.S. Cl.
CPC ..... *H01B 5/02* (2013.01); *C22C 21/00* (2013.01); *H01B 5/08* (2013.01); *H01B 13/0036* (2013.01)

(58) Field of Classification Search
CPC ... H01B 5/02; H01B 5/04; H01B 5/06; H01B 5/08; H01B 11/02; H01B 11/04; H01B 11/06; H01B 13/0036; H01R 43/00
(Continued)

(56) References Cited

U.S. PATENT DOCUMENTS 2,891,309 A * 6/1959 Fenster ..... C25D 5/44 72/364
3,622,470 A * 11/1971 Gowman ..... C25D 7/0614 205/213
(Continued)

FOREIGN PATENT DOCUMENTS

JP 2012-099219 A 5/2012
JP 2013-122911 A 6/2013
JP 2016-035872 A 3/2016

OTHER PUBLICATIONS

International Search Report for corresponding Application No. PCT/JP2020/015418, dated Jun. 9, 2020.

*Primary Examiner* — William H. Mayo, III
(74) *Attorney, Agent, or Firm* — Renner, Otto, Boisselle & Sklar, LLP

(57) ABSTRACT

An aluminum base wire includes a core wire composed of pure aluminum or an aluminum alloy; a plurality of coating pieces provided so as to be scattered on an outer periphery of the core wire; and a coating layer provided on the outer periphery of the core wire and an outer periphery of each of the plurality of coating pieces. The coating layer includes a first layer that is provided continuously on the outer periphery of the core wire between adjacent coating pieces and the outer periphery of each of the plurality of coating pieces, and a second layer provided on an outer periphery of the first layer. The plurality of coating pieces are each composed of copper or a copper alloy, the first layer is composed of metals that include copper and tin, and the second layer is composed of tin or a tin alloy.

9 Claims, 1 Drawing Sheet

(51) Int. Cl.
*H01B 5/08* (2006.01)
*H01B 13/00* (2006.01)

(58) Field of Classification Search
USPC ..... 174/36, 102 R, 102 SC, 120 R, 121 R
See application file for complete search history.

(56) References Cited

U.S. PATENT DOCUMENTS 3,775,264 A * 11/1973 Bharucha ..... C25D 5/44
205/213
3,867,265 A * 2/1975 Hansson ..... C25D 3/02
205/213
3,881,999 A * 5/1975 Toth ..... C25D 5/10
428/673
4,126,522 A * 11/1978 Edlund ..... C25D 5/44
205/213
5,246,565 A * 9/1993 Nignardot ..... C25D 5/12
205/213
5,249,731 A * 10/1993 Ziemek ..... B21C 37/0818
228/148
6,178,623 B1 * 1/2001 Kitazawa ..... H01L 24/45
205/176
2006/0102368 A1 * 5/2006 Michel epouse Allaire .....
H01B 13/02
174/36
2013/0118798 A1 5/2013 Hiraike

* cited by examiner

ALUMINUM BASE WIRE, STRANDED WIRE, AND METHOD FOR MANUFACTURING ALUMINUM BASE WIRE

TECHNICAL FIELD

The present disclosure relates to an aluminum base wire, a stranded wire, and a method for manufacturing an aluminum base wire.

The present application claims the benefit of priority based on Japanese Patent Application No. 2019-086664 filed on Apr. 26, 2019, which is incorporated herein by reference in its entirety.

BACKGROUND ART

Patent Document 1 discloses a conductor provided with an aluminum metal wire and a coating layer covering a surface of the aluminum metal wire as an aluminum base wire provided with a core wire and a coating layer covering a surface of the core wire. This coating layer has a base plating layer made of nickel, a copper plating layer, and a surface plating layer made of tin or a tin alloy in the stated order from the aluminum metal wire side. The copper plating layer has a thickness of 20 μm. This conductor is manufactured through a wire drawing process in which wire drawing is performed on a base member in which the plating layers are provided on a surface of the aluminum metal wire.

CITATION LIST

Patent Documents

Patent Document 1: JP 2013-122911A

SUMMARY OF INVENTION

An aluminum base wire according to the present disclosure includes:

a core wire composed of pure aluminum or an aluminum alloy;

a plurality of coating pieces provided so as to be scattered on an outer periphery of the core wire; and a coating layer provided on the outer periphery of the core wire and an outer periphery of each of the plurality of coating pieces;

in which the coating layer includes a first layer that is provided continuously on the outer periphery of the core wire between adjacent coating pieces and the outer periphery of each of the plurality of coating pieces; and a second layer provided on an outer periphery of the first layer, the plurality of coating pieces are each composed of copper or a copper alloy, the first layer is composed of metals that include copper and tin, and the second layer is composed of tin or a tin alloy.

The stranded wire according to the present disclosure is obtained by twisting a plurality of the aluminum base wires according to the present disclosure together.

A method for manufacturing an aluminum base wire according to the present disclosure includes:

a step of preparing a base member provided with a core wire composed of pure aluminum or an aluminum alloy and a coating layer provided on an outer periphery of the core wire;

a step of heating the base member; and a step of performing wire drawing on the base member that was heated, in which the coating layer includes a first base member layer provided on the outer periphery of the core wire, and a second base member layer provided on an outer periphery of the first base member layer, the first base member layer is composed of copper or a copper alloy, the first base member layer has a thickness of 2 μm or less, and the second base member layer is composed of tin or a tin alloy.

DESCRIPTION OF EMBODIMENTS

Figure 1:
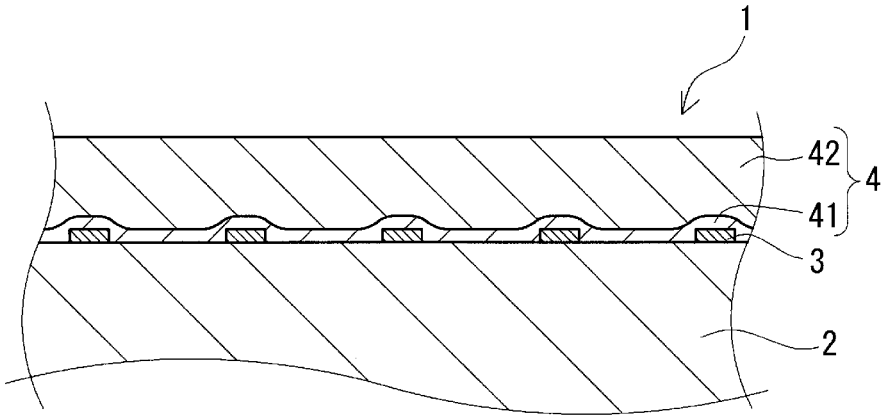
FIG. 1 is a cross-sectional view showing an overview of an aluminum base wire according to Embodiment 1.

Problem to be Solved by the Present Disclosure

When bending is applied to the above-described conductor, the coating layer may crack. Cracks in the coating layer may lead to the exposure of the core wire. If moisture enters through the cracked portion in the coating layer and reaches the portion of contact between the core wire and the coating layer, the surface of the core wire is corroded. This corrosion is called galvanic corrosion.

In view of this, an object of the present disclosure is to provide an aluminum base wire whose coating layer is unlikely to crack even if bending is applied thereto.

Also, another object of the present disclosure is to provide a stranded wire whose wires are easily twisted together.

Furthermore, another object of the present disclosure is to provide a method for manufacturing an aluminum base wire by which it is possible to manufacture the aluminum base wire whose coating layer is unlikely to crack even if bending is applied thereto.

Advantageous Effects of the Present Disclosure

An aluminum base wire according to the present disclosure is unlikely to crack even if bending is applied thereto.

With regard to a stranded wire according to the present disclosure, multiple aluminum base wires can be easily twisted together.

With the method for manufacturing an aluminum base wire according to the present disclosure, it is possible to manufacture the aluminum base wire whose coating layer is unlikely to crack even if bending is applied thereto.

DESCRIPTION OF EMBODIMENTS OF THE PRESENT DISCLOSURE

First, embodiments of the present disclosure will be described below.

(1) An aluminum base wire according to an aspect of the present disclosure includes:

a core wire composed of pure aluminum or an aluminum alloy;

a plurality of coating pieces provided so as to be scattered on an outer periphery of the core wire; and a coating layer provided on the outer periphery of the core wire and an outer periphery of each of the plurality of coating pieces;

in which the coating layer includes a first layer that is provided continuously on the outer periphery of the core wire between adjacent coating pieces and the outer periphery of each of the plurality of coating pieces; and a second layer provided on an outer periphery of the first layer, the plurality of coating pieces are each composed of copper or a copper alloy, the first layer is composed of metals that include copper and tin, and the second layer is composed of tin or a tin alloy.

With the above-described configuration, the coating layer is unlikely to crack even if bending is applied. Therefore, the above-described configuration can reduce the exposure of the core wire. Thus, the above-described configuration can suppress the corrosion of the surface of the core wire.

In the following description, the aluminum base wire may be referred to as an "Al base wire". The mechanism by which the coating layer is cracked in the above-described conventional Al base wire due to bending being applied thereto is as follows. As described above, the thickness of a copper plating layer in the conventional Al base wire is very large. Also, copper has low ductility, compared to Al and tin. Therefore, when bending is applied to the Al base wire, the copper plating layer cracks. The plating layer that is adjacent to the copper plating layer cracks accompanying a crack in the copper plating layer.

In contrast, the Al base wire of the present disclosure is not provided with a layer such as a conventional copper plating layer, which cracks when bending is applied thereto, between the core wire and the coating layer. That is, the Al base wire of the present disclosure is not provided with a layer such as a conventional copper plating layer, which will serve as a start point of a crack in the coating layer when bending is applied thereto, between the core wire and the coating layer. With the Al base wire of the present disclosure, a plurality of coating pieces composed of a copper-based material are scattered between the core wire and the coating layer. The plurality of coating pieces are unlikely to crack even if bending is applied to the Al base wire, compared to the conventional copper plating layer, and are less likely to serve as start points of cracks in the coating layer. Therefore, the coating layer is unlikely to crack even if bending is applied to the Al base wire.

Also, with the above-described configuration, the adhesion between the core wire composed of an Al-based material and the second layer composed of a tin-based material is improved. Usually, the adhesion between Al and tin is poor. However, the reason why the adhesion therebetween is improved is that, with the above-described configuration, the coating pieces and the first layer, which contain copper that has high adhesion to Al and tin, are interposed between the core wire and the second layer.

Furthermore, with the above-described configuration, the coating pieces are unlikely to peel off from the core wire even if bending is applied to the Al base wire. The reason therefor is that the coating pieces are not in the form of layers such as the conventional copper plating layer.

(2) As an embodiment of the aluminum base wire, the coating pieces have a thickness of 1.5 μm or less.

With the above-described configuration, the coating pieces are unlikely to crack even if bending is applied to the Al base wire. The reason therefor is that the coating pieces have high flexibility because the coating pieces are thin. Also, even if bending is applied to the Al base wire and a coating piece is cracked, the load on the coating layer due to cracking of the coating piece is small. The reason therefor is that the thickness of the coating piece is sufficiently small.

(3) As an embodiment of the aluminum base wire, the coating pieces have a width of 20 μm or less.

With the above-described configuration, the coating pieces are unlikely to crack even if bending is applied to the Al base wire. The reason therefor is that the width of the coating pieces is sufficiently narrow.

(4) As an embodiment of the aluminum base wire, a distance between coating pieces that are adjacent to each other in a longitudinal direction of the core wire is 0.5 μm or more.

With the above-described configuration, the coating pieces are unlikely to crack even if bending is applied to the Al base wire. The reason therefor is that, because the distance between adjacent coating pieces is sufficiently long, it is possible to prevent contact between adjacent coating pieces when bending is applied thereto.

(5) As an embodiment of the aluminum base wire, the first layer has a thickness of 0.1 μm or more and 3 μm or less.

When the thickness of the first layer is 0.1 μm or more, the adhesion between the core wire and the second layer is high. The reason therefor is that the thickness of the first layer is sufficiently large. When the thickness of the first layer is 3 μm or less, the first layer is not excessively thick. Therefore, with the Al base wire in which the thickness of the first layer satisfies 3 μm or less, the adhesion of the first layer to the core wire and the coating pieces is improved.

(6) As an embodiment of the aluminum base wire, an area ratio $\alpha:\beta$ between an area $\alpha$ of the coating piece on a cross-section extending along the longitudinal direction of the core wire and an area $\beta$ of the first layer is 1:1 or more and 1:120 or less.

With the above-described configuration, the coating layer is unlikely to crack even if bending is applied to the Al base wire. Furthermore, with the above-described configuration, the adhesion between the core wire and the second layer is improved. This is because, when the above-described area ratio $\alpha:\beta$ satisfies the above-described range, the coating pieces and the first layer are present in a well-balanced manner.

(7) As an embodiment of the aluminum base wire, the aluminum base wire has a diameter of 0.01 mm or more and 0.6 mm or less.

The above-described configuration can be easily used for various applications. The reason therefor is that the coating layer is unlikely to crack even though the Al base wire is a thin wire that is likely to bend.

(8) A stranded wire according to an aspect of the present disclosure is obtained by twisting a plurality of the aluminum base wires according to any one of (1) to (7) above together.

With the above-described configuration, the productivity is improved. The reason therefor is that the stranded wire has the Al base wire whose coating layer is unlikely to crack even if bending is applied, and the Al base wires can be easily twisted together.

(9) A method for manufacturing an aluminum base wire according to an aspect of the present disclosure includes:

a step of preparing a base member provided with a core wire composed of pure aluminum or an aluminum alloy and a coating layer provided on an outer periphery of the core wire;

a step of heating the base member; and a step of performing wire drawing on the base member that was heated;

in which the coating layer includes a first base member layer provided on the outer periphery of the core wire, and a second base member layer provided on an outer periphery of the first base member layer, the first base member layer is composed of copper or a copper alloy, the first base member layer has a thickness of 2 μm or less, and the second base member layer is composed of tin or a tin alloy.

With the above-described configuration, it is possible to manufacture the Al base wire whose coating layer is unlikely to crack even if bending is applied thereto. The base member, which is to be subjected to wire drawing, is provided with the coating layer including the first base member which is thin. Therefore, the first base member layer cracks in wire drawing. Due to cracking in the first base member layer, the plurality of coating pieces are formed in the above-described Al base wire. Also, a copper component contained in the first base member layer is diffused into the second base member layer by heating the base member before wire drawing. The first layer is formed in the above-described Al base wire due to diffusion of copper. The second base member layer forms the second layer of the Al base wire after wire drawing. Also, by heating the base member before wire drawing, it is possible to manufacture the Al base wire with high bendability.

DETAILS OF EMBODIMENTS OF THE PRESENT DISCLOSURE

Embodiments of the present disclosure will be described in detail below. The same reference numerals in the drawings indicate objects having the same names. In the following description, the aluminum base wire may be referred to as "Al base wire".

Embodiment 1

Aluminum Base Wire

An Al base wire 1 according to Embodiment 1 will be described with reference to FIG. 1. FIG. 1 shows a cross-sectional view obtained by cutting the Al base wire 1 along the longitudinal direction of a core wire 2. The Al base wire 1 is provided with the core wire 2 composed of pure Al or an Al alloy. One of the characteristics of the Al base wire 1 is that the Al base wire 1 is provided with a plurality of coating pieces 3 provided so as to be scattered on an outer periphery of the core wire 2 and a coating layer 4 having a specific structure provided on the outer peripheries of the core wire 2 and the plurality of coating pieces 3. Each coating piece 3 is composed of a copper-based material. The coating layer 4 has a first layer 41 provided in a specific range on the outer peripheries of the core wire 2 and the plurality of coating pieces 3 and a second layer 42 provided on an outer periphery of the first layer 41. The first layer 41 is composed of a specific material. The second layer 42 is composed of a tin-based material. The following describes each constituent element thereof in detail.

Core Wire

The core wire 2 is composed of pure aluminum (Al) or an Al alloy. Pure Al allows inclusion of inevitable impurities other than Al. Examples of the Al alloy include Al alloys that contain additive elements and have various compositions in which the remaining portion includes Al and inevitable impurities.

The additive element may be at least one element selected from the group consisting of iron (Fe), magnesium (Mg), silicon (Si), copper (Cu), zinc (Zn), nickel (Ni), manganese (Mn), silver (Ag), chromium (Cr), and zirconium (Zr), for example. These additive elements may be elements of only one type or a combination of two or more types. Examples of such an alloy include Al—Fe alloys, Al—Fe—Mg alloys, Al—Fe—Si alloys, Al—Fe—Mg—(Mn, Ni, Zr, Ag) alloys, Al—Fe—Cu alloys, Al—Fe—Cu—(Mg, Si) alloys, and Al—Mg—Si—Cu alloys.

The total content of the additive elements is preferably 0.005 mass % or more and 5.0 mass % or less, and more preferably 0.1 mass % or more and 2.0 mass % or less. The preferred content of each additive element is as follows. The Fe content is preferably 0.005 mass % or more and 2.2 mass % or less. The Mg content is preferably 0.05 mass % or more and 1.0 mass % or less. The Si content is preferably 0.04 mass % or more and 1.0 mass % or less. The Cu content is preferably 0.05 mass % or more and 0.5 mass % or less. The total content of Zn, Ni, Mn, Ag, Cr, and Zr is preferably 0.005 mass % or more and 0.2 mass % or less.

The composition of the core wire 2 can be obtained through high frequency inductively coupled plasma optical emission spectrometry (ICP-OES). Specifically, the composition of the core wire 2 can be obtained using iCAP6500 manufactured by Thermo Fisher Scientific.

The diameter of the core wire 2 is preferably 0.01 mm or more and 0.6 mm or less, for example, although it depends on applications of the Al base wire 1 and the like. The diameter refers to the diameter of the core wire 2, which is a single wire. The core wire 2 whose diameter satisfies the above-described range can be easily used for various applications.

The diameter of the core wire 2 can be obtained through cross-sectional observation using a scanning electron microscope (SEM). First, four or more transverse sections of the Al base wire 1 are obtained. A transverse section refers to a cross-section that is orthogonal to the longitudinal direction of the Al base wire 1. The area of the core wire 2 on each transverse section is obtained. The area of the core wire 2 can be obtained using image analysis software. The boundary between the core wire 2 and a base layer, which will be described later, and the boundary between the core wire 2 and the coating layer 4 can be identified because interfaces are formed. The average of the diameters of equal-area circles obtained by converting each area into the area of a complete round is obtained. This average is used as the diameter of the core wire 2.

Coating Pieces

Coating pieces 3 are provided so as to be scattered directly on the core wire 2 or directly on a base layer if the base layer is provided directly on the core wire 2. The plurality of coating pieces 3 are provided directly on the core wire 2 or the base layer so as to be spaced apart from each other. Adjacent coating pieces 3 may be continuous with each other. Usually, the size of each coating piece 3 and the distance between coating pieces 3 is not constant. In this manner, the Al base wire 1 is not provided with a layer such as a conventional copper plating layer, which cracks when bending is applied to the Al base wire 1 and serves as a start point of a crack in the coating layer 4, between the core wire 2 and the coating layer 4. Therefore, the coating layer 4 is unlikely to crack even if bending is applied to the Al base wire 1. Also, the plurality of coating pieces 3 are scattered in the first layer 41 in the form of islands. The thickness and the width of the coating pieces 3 shown in FIG. 1 and the distance between adjacent coating pieces 3 are schematically shown, and do not necessarily correspond to the actual thicknesses.

The material of the coating pieces 3 is at least one metal selected from the group consisting of Cu and Cu alloys. Cu allows inclusion of inevitable impurities other than Cu. Examples of the Cu alloys include Cu—Sn (tin) alloys, Cu—Zn alloys, Cu—Ni alloys, and Cu—Sn—Ni alloys. The composition of the coating pieces 3 can be obtained using a method that is similar to the above-described method for obtaining the composition of the core wire 2. The same applies to the composition of the first layer 41 and the composition of the second layer 42, which will be described later.

The coating pieces 3 have a thickness of 1.5 μm or less, for example. If the coating pieces 3 have a thickness of 1.5 μm or less, the coating pieces 3 are sufficiently thin. Therefore, the coating pieces 3 have high flexibility. Consequently, the coating pieces 3 are unlikely to crack even if bending is applied to the Al base wire 1. Also, when bending is applied to the Al base wire 1, even if a coating piece 3 is cracked, the load applied to the coating layer 4 due to cracking of the coating piece 3 is small. The coating pieces 3 have a thickness of 0.01 μm or more, for example. If the coating pieces 3 have a thickness of 0.01 μm or more, the coating pieces 3 are not excessively thin. Therefore, when bending is applied to the Al base wire 1, the coating pieces 3 are unlikely to crack. The coating pieces 3 may also have a thickness of 0.05 μm or more and 1.2 μm or less, and in particular, have a thickness of 0.1 μm or more and 1.0 μm or less.

The thickness of the coating pieces 3 can be measured as follows. Three or more observation fields are obtained on a cross-section extending along the longitudinal direction of the Al base wire 1, that is, on a longitudinal section of the Al base wire 1. In a method for obtaining each observation field, multiple coating pieces 3 are included in the same field and the boundary between the coating pieces 3 and the core wire 2 or between the coating pieces 3 and the base layer and the boundary between the coating pieces 3 and the first layer 41 are included therein. The magnification of each observation field is 1000. The size of each observation field is 12.5 μm×10 μm. The lengths of all of the coating pieces 3 included in each observation field along the radial direction of the core wire 2 are measured. The length of each coating piece 3 along the radial direction of the core wire 2 means the maximum length of the coating piece 3. The average of the measured lengths of all of the coating pieces 3 is obtained. This average is used as the thickness of the coating pieces 3.

The coating pieces 3 have a width of 20 μm or less, for example. If the coating pieces 3 have a width of 20 μm or less, the width of the coating pieces 3 is narrow. Therefore, even if bending is applied to the Al base wire 1, the coating pieces 3 are unlikely to crack. The coating pieces 3 have a width of 0.1 μm or more, for example. If the coating pieces 3 have a width of 0.1 μm or more, the width of the coating pieces 3 is not excessively narrow. Therefore, the coating pieces 3 are likely to improve the adhesion between the core wire 2 and the first layer 41, or the adhesion between the base layer and the first layer 41. The coating pieces 3 may also have a width of 0.5 μm or more and 15 μm or less, and in particular, have a width of 1 μm or more and 10 μm or less.

The width of the coating pieces 3 can be measured as follows. Similarly to the method for measuring the thickness of the coating pieces 3, three or more observation fields are obtained on a longitudinal section of the Al base wire 1. The method for obtaining each observation field and the magnification and size thereof are the same as those in the method for measuring the thickness of the coating pieces 3. The lengths of all of the coating pieces 3 included in each observation field along the longitudinal direction of the core wire 2 are measured. The length of each coating piece 3 along the longitudinal direction of the core wire 2 means the maximum length of the coating piece 3. The average of the measured lengths of all of the coating pieces 3 is obtained. This average is used as the width of the coating pieces 3.

The distance between coating pieces 3 that are adjacent to each other in the longitudinal direction of the core wire 2 is 0.5 μm or more, for example. The longitudinal direction of the core wire 2 is the left-right direction of the page surface of FIG. 1. When the above-described distance is 0.5 μm or more, the distance is wide. Therefore, contact between adjacent coating pieces 3, which occurs when bending is applied to the Al base wire 1, is prevented. Therefore, the coating pieces 3 are unlikely to crack even if bending is applied to the Al base wire 1. The above-described distance is 20 μm or less, for example. When the above-described distance is 20 μm or less, the distance is not excessively wide. Therefore, a location where no first layer 41 is formed is unlikely to be present between adjacent coating pieces 3. Therefore, it is possible to suppress a decrease in the adhesion between the core wire 2 and the second layer 42 or the adhesion between the base layer and the second layer 42. The above-described distance may also be 0.8 μm or more and 15 μm or less, and in particular, 1 μm or more and 10 μm or less.

The distance between the coating pieces 3 that are adjacent to each other in the longitudinal direction of the core wire 2 can be measured as follows. Similarly to the method for measuring the thickness of the coating pieces 3, three or more observation fields are obtained on a longitudinal section of the Al base wire 1. The method for obtaining each observation field and the magnification and size thereof are the same as those in the method for measuring the thickness of the coating pieces 3. All of the distances between adjacent coating pieces 3 in each observation field are measured. The distance between adjacent coating pieces 3 means the minimum length between adjacent coating pieces 3. The average of all of the measured distances was obtained. This average is used as the distance between the coating pieces 3 that are adjacent to each other in the longitudinal direction of the core wire 2.

Coating Layer

The coating layer 4 covers the outer peripheries of the coating pieces 3 and chemically protects the core wire 2. The coating layer 4 has a multilayer structure having the first layer 41 and the second layer 42 in the stated order from the core wire 2 side. The thicknesses of the first layer 41 and the second layer 42 in FIG. 1 are schematically shown, and do not necessarily correspond to the actual thicknesses.

First Layer

The first layer 41 is provided directly on the core wire 2 between coating pieces 3 or directly on a base layer between coating pieces 3 when the base layer, which will be described later, is provided and directly on the coating pieces 3, continuously over the entire outer periphery of the core wire 2 or the base layer and the outer peripheries of the coating pieces 3. That is, the first layer 41 has portions provided directly on the core wire 2 or the base layer between coating pieces 3, and portions provided directly on the coating pieces 3. The portions provided directly on the core wire 2 or the base layer between coating pieces 3 and the portions provided directly on the coating pieces 3 are continuous with each other.

The material of the first layer 41 contains Cu and Sn. The first layer 41 may contain an alloy of Cu and Sn. The first layer 41 may be composed of substantially Cu and Sn. "Being composed of substantially only Cu and Sn" refers to allowing inclusion of inevitable impurities other than Cu and Sn. The Sn content in the first layer 41 is smaller than the Sn content in the second layer 42. The ratio Cu:Sn between Cu and Sn in the first layer 41 is 1:1 or more and 1:5 or less, for example, and may also be 1:1.1 or more and 1:3 or less, and in particular, 1:1.2 or more and 1:2.5 or less.

The first layer 41 has a thickness of 0.1 μm or more and 3 μm or less, for example. When the thickness of the first layer 41 is 0.1 μm or more, the adhesion between the core wire 2 and the second layer 42 is high. The reason therefor is that the thickness of the first layer 41 is sufficiently large. When the thickness of the first layer 41 is 3 μm or less, the first layer 41 is not excessively thick. Therefore, with the Al base wire 1 whose first layer 41 has a thickness of 3 μm or less, the adhesion of the first layer 41 to the core wire 2 or the base layer and to the coating pieces 3 are improved. The first layer 41 may also have a thickness of 0.3 μm or more and 2.5 μm or less, and in particular, have a thickness of 0.5 μm or more and 2 μm or less.

The thickness of the first layer 41 can be measured as follows. Similarly to the method for measuring the thickness of the coating pieces 3, three or more observation fields are obtained on a longitudinal section of the Al base wire 1. In a method for obtaining each observation field, the boundary between the first layer 41 and the core wire 2 or the boundary between the first layer 41 and the base layer, and the boundary between the first layer 41 and the second layer 42 are included therein. The magnification of each observation field is 1000. The size of each observation field is 12.5 μm×10 μm. The length of the first layer 41 in each observation field along the radial direction of the core wire 2 is measured at five or more positions. At this time, it is preferable that the number of measurements of the length of the first layer 41 on the coating pieces 3 and the number of measurements of the length of the first layer 41 between coating pieces 3 are the same. The average of the measured lengths of the first layer 41 is obtained. This average is used as the thickness of the first layer 41.

Area Ratio Between Coating Piece and First Layer

An area ratio α:β between an area α of the coating pieces 3 and an area β of the first layer 41 on a longitudinal section of the Al base wire 1 is 1:1 or more and 1:120 or less, for example. When the area ratio α:β satisfies the above-described range, the coating layer 4 is unlikely to crack even if bending is applied thereto. Furthermore, the adhesion between the core wire 2 and the second layer 42 is improved. This is because the coating pieces 3 and the first layer 41 are present in a well-balanced manner. The area ratio α:β may also be 1:3 or more and 1:60 or less, and in particular, 1:5 or more and 1:30 or less.

The above-described area α and the above-described area β can be obtained as follows. Three or more observation fields are obtained on a longitudinal section of the Al base wire 1. The method for obtaining each observation field and the magnification and size thereof are the same as those in the method for measuring the thickness of the first layer 41. The area of all of the coating pieces 3 and the area of the first layer 41 in each observation field are measured. Each area can be obtained using image analysis software. The average of all of the measured areas of the coating pieces 3 and the average of all of the measured areas of the first layer 41 are obtained. The obtained averages are respectively used as the above-described area α and the above-described area β.

Second Layer

The second layer 42 is provided directly on the first layer 41 over the entire outer periphery of the first layer 41.

The material of the second layer 42 is at least one metal selected from the group consisting of Sn and Sn alloys. Sn allows inclusion of inevitable impurities other than Sn. Examples of the Sn alloys include Sn—Cu alloys, Sn—Ag—Cu alloys, and Sn—In (indium) alloys. The Sn content in the second layer 42 is larger than the Sn content in the first layer 41. Specifically, the Sn content in the second layer 42 is 100 atomic % or less. The Sn content in the second layer 42 is 85 atomic % or more, for example. The Sn content in the second layer 42 may also be 90 atomic % or more, and in particular, 95 atomic % or more. The Sn content in the second layer 42 refers to a value obtained when the value of elements other than C and 0 in the second layer 42 that are detected through ICP-OES is set to 100 atomic %.

The second layer 42 preferably has a thickness of 0.3 μm or more, for example. When the thickness of the second layer 42 is 0.3 μm or more, the core wire 2 has high corrosion resistance. The reason therefor is that the thickness of the second layer 42 is sufficiently large, and thus pinholes are unlikely to be formed. The upper limit of the thickness of the second layer 42 is, but is not particularly limited to, 10 μm or less, for example. The thickness of the second layer 42 is more preferably 0.5 μm or more and 7 μm or less, and particularly preferably 1 μm or more and 5 μm or less.

The thickness of the second layer 42 can be measured as follows. Similarly to the method for measuring the thickness of the coating pieces 3, three or more observation fields are obtained on a longitudinal section of the Al base wire 1. In a method for obtaining each observation field, the boundary between the second layer 42 and the first layer 41 and the outer peripheral surface of the second layer 42 are included therein. The magnification of each observation field and the size of the observation field are set in the same manner as those in the method for measuring the thickness of the first layer 41. The length of the second layer 42 in each observation field along the radial direction of the core wire 2 is measured at five or more positions. At this time, it is preferable that the number of measurements of the length of the second layer 42 at a crest of the first layer 41 and the number of measurements of the length of the second layer 42 at a trough of the first layer 41 are the same. The "crest" of the first layer 41 refers to an outer peripheral portion of a coating piece 3. The "trough" of the first layer 41 refers to a region between adjacent coating pieces 3. The average of all of the measured thicknesses of the second layer 42 is obtained. This average is used as the thickness of the second layer 42.

Others

The Al base wire 1 may further include a base layer, although it is not shown in the drawings.

Base Layer

The base layer improves the adhesion between the core wire 2 and the coating pieces 3 and the adhesion between the core wire 2 and the coating layer 4. The base layer is provided directly on the core wire 2 over the entire outer periphery of the core wire 2.

The base layer contains Zn as the main component. The base layer, which contains Zn as the main component, is likely to improve the adhesion between the core wire 2 and the first layer 41 and the second layer 42. The main component means that the Zn content satisfies 60 atomic % or more when the content of all of the constituent elements of the base layer is 100 atomic %. The Zn content is more preferably 75 atomic % or more, and particularly preferably 80 atomic % or more. The base layer may be composed of substantially only Zn. "Being composed of substantially only Zn" refers to allowing inclusion of inevitable impurities other than Zn. The material of the base layer can be determined through energy-dispersive X-ray analysis (EDX) using a scanning transmission electron microscope (STEM) on a cross-section of the Al base wire 1 that has been processed with a focused ion beam (FIB), for example.

The base layer has a thickness of 5 nm or more and 100 nm or less, for example. When the thickness of the base layer is 5 nm or more, the base layer can improve the adhesion between the core wire 2 and the coating pieces 3 and the adhesion between the core wire 2 and the first layer 41. When the thickness of the base layer is 100 nm or less, the Al base wire 1 has high workability. The reason therefor is that the base layer is not excessively thick. The thickness of the base layer is preferably 8 nm or more and 50 nm or less, and particularly preferably 10 nm or more and 30 nm or less.

Wire Diameter

The Al base wire 1 has a wire diameter of 0.01 mm or more and 0.6 mm or less, for example. The Al base wire 1 whose wire diameter is in the above-described range can be easily used for various applications. The reason therefor is that the coating layer 4 is unlikely to crack even though the Al base wire 1 is a thin wire that is likely to bend. The Al base wire 1 may also have a wire diameter of 0.05 mm or more and 0.5 mm or less, and in particular, have a wire diameter of 0.1 mm or more and 0.4 mm or less. The wire diameter of the Al base wire 1 can be measured as follows. Similarly to the method for measuring the diameter of the core wire 2, four or more transverse sections of the Al base wire 1 are obtained. The area of the Al base wire 1 on each transverse section is obtained. The average of the diameters of equal-area circles obtained by converting each area into the area of a complete round is obtained. This average is used as the wire diameter of the Al base wire 1.

Applications

The Al base wire 1 of this embodiment can be suitably used for single wires, stranded wires, compressed wires, insulated electric wires, and conductors of terminal-equipped electrical wires. A stranded wire is obtained by twisting multiple single wires together. A compressed wire is obtained through compression molding of a stranded wire. An insulated electric wire includes an insulating coating on an outer periphery of any of a single wire, a stranded wire, and a compressed wire. A terminal-equipped electrical wire includes a terminal member that is attached to any of an end portion of a stranded wire, an end portion of a compressed wire, and an end portion of an Al base wire that is exposed through local removal of an insulating coating of an insulated electric wire. Examples of the terminal member include a terminal member made of Cu or a Cu alloy, and a terminal member that has a main body portion made of Cu or a Cu alloy and a Sn layer or a Sn plating layer that is formed on the surface of the main body portion.

Effects

With the Al base wire 1 of this embodiment, the coating layer 4 is unlikely to crack even if bending is applied thereto. The Al base wire 1 is not provided with a layer such as a conventional copper plating layer, which cracks when bending is applied to the Al base wire 1 and serves as a start point of a crack in the coating layer 4, between the core wire 2 and the coating layer 4, and the Al base wire 1 is provided with a plurality of coating pieces 3 that are scattered. Furthermore, with the Al base wire 1 of this embodiment, the adhesion between the core wire 2 and the second layer 42 is improved. This is because, with the Al base wire 1, the coating pieces 3 and the first layer 41, which contain Cu that has high adhesion to Al and Sn, are interposed between the core wire 2 and the second layer 42. Furthermore, even if bending is applied to the Al base wire 1 of this embodiment, the coating pieces 3 are unlikely to peel off. This is because the first layer 41 covers the outer peripheries of the coating pieces 3 and is interposed between coating pieces 3 in the Al base wire 1.

Method for Manufacturing Al Base Wire

Figure 2:
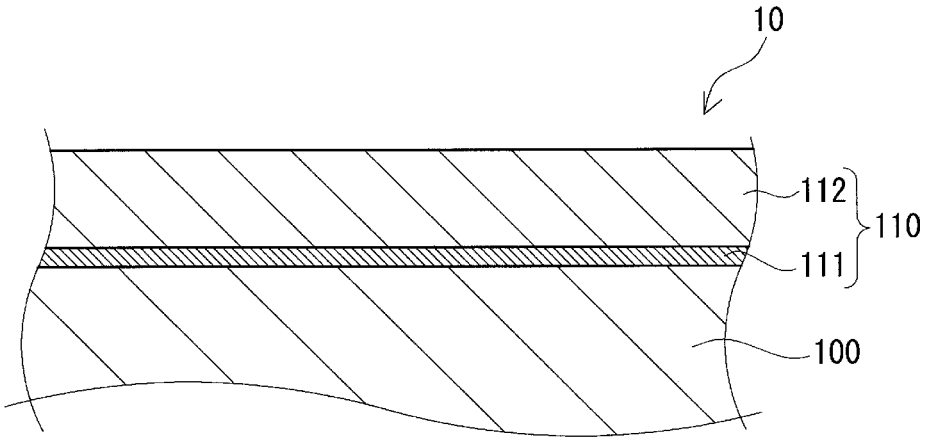
FIG. 2 is a explanatory diagram illustrating a method for manufacturing an aluminum base wire according to Embodiment 1.

A method for manufacturing the Al base wire according to Embodiment 1 will be described mainly with reference to FIG. 2. FIG. 2 shows a cross-sectional view obtained by cutting a base member 10 along the longitudinal direction of a core wire 100. The method for manufacturing the Al base wire according to this embodiment includes a step S1 of preparing the base member 10, a step S2 of heating the base member 10, and a step S3 of performing wire drawing on the base member 10.

Step S1

The base member 10 to be prepared includes the core wire 100 and a coating layer 110 provided on an outer periphery of the core wire 100. The coating layer 110 includes a first base member layer 111 provided on the outer entire periphery of the core wire 100 and a second base member layer 112 provided on an outer periphery of the first base member layer 111. The base member 10 can be prepared by forming the coating layer 110 on the outer periphery of the prepared core wire 100. Alternatively, the base member 10 can be prepared by forming the base layer and the coating layer 110 on the outer periphery of the prepared core wire 100 in the stated order.

Preparation of Core Wire

The core wire 100 to be prepared is composed of pure Al or an Al alloy. The pure Al and the Al alloy are the same as those in the description of the core wire 2 of the Al base wire 1 above. The diameter of the core wire 100 is 0.3 mm or more and 5 mm or less, for example, and may also be 0.4 mm or more and 2 mm or less, and in particular, 0.5 mm or more and 1 mm or less.

Formation of Base Layer

The base layer can be formed by performing zincate treatment or double zincate treatment on the core wire 100. Known conditions can be used as treatment conditions.

Formation of Coating Layer

The coating layer 110 can be formed by providing the first base member layer 111 and the second base member layer 112 on the outer periphery of the core wire 100 or the base layer in the stated order.

The first base member layer 111 is composed of Cu or a Cu alloy. Cu and the Cu alloy are the same as those in the description of the coating pieces 3 of the Al base wire 1 above. The first base member layer 111 is provided directly on the core wire 100 or the base layer, over the entire outer periphery of the core wire 100 or the base layer. The thickness of the first base member layer 111 can be selected as appropriate according the diameter of the core wire 100 and the final wire diameter obtained after step S3, which will be described later. The first base member layer 111 has a thickness of 2 μm or less, for example. When the thickness of the first base member layer 111 is 2 μm or less, it is possible to manufacture the Al base wire 1 having the above-described coating pieces 3 through wire drawing, which will be described later. The reason therefor is that the first base member layer 111 is likely to crack in wire drawing because the first base member layer 111 is thin. The first base member layer 111 has a thickness of 0.1 μm or more, for example. When the thickness of the first base member layer 111 is 0.1 μm or more, the first base member layer 111 with a uniform thickness can be easily provided over the entire outer periphery of the core wire 100 or the base layer. The first base member layer 111 may also have a thickness of 0.3 μm or more and 1.5 μm or less, and in particular, have a thickness of 0.5 μm or more and 1.0 μm or less.

The second base member layer 112 is composed of Sn or a Sn alloy. Sn and the Sn alloy are the same as those in this description of the second layer 42 (FIG. 1) of the Al base wire 1. The second base member layer 112 is provided directly on the first base member layer 111 over the entire outer periphery of the first base member layer 111. Similarly to the first base member layer 111, the thickness of the second base member layer 112 can be selected as appropriate according the diameter of the core wire 100 and the final wire diameter obtained after step S3, which will be described later. The second base member layer 112 has a thickness of 1 μm or more and 40 μm or less, for example. When the thickness of the second base member layer 112 is 1 μm or more, it is possible to easily manufacture the Al base wire 1 having the above-described second layer 42 with a sufficient thickness through wire drawing, which will be described later. When the thickness of the second base member layer 112 is 40 μm or less, the productivity of the Al base wire 1 can be increased. The reason therefor is that the time for forming the second base member layer 112 is not excessively long because the second base member layer 112 is not excessively thick. The thickness of the second base member layer 112 may also be 3 μm or more and 20 μm or less, and in particular, 5 μm or more and 15 μm or less.

The first base member layer 111 and the second base member layer 112 can be formed through plating, vapor deposition, fitting, or the like. Examples of plating include electroplating, electroless plating, and hot clipping. Known plating conditions can be used to form the first base member layer 111 and the second base member layer 112 through plating. Examples of vapor deposition include CVD (Chemical Vapor Deposition), and PVD (Physical Vapor Deposition). The base member 10 can be produced through fitting as follows, for example. An outer periphery of a wire, which will ultimately be the core wire 100, is covered with a first pipe and a second pipe in the stated order from the inner side. The first pipe is made of a constituent material of the first base member layer 111, and will ultimately be the first base member layer 111. The second pipe is made of a constituent material of the second base member layer 112, and will ultimately be the second base member layer 112. Wire drawing is performed on the assembly. Because the members such as the pipes made of the constituent material of the first base member layer 111 are thick, the first base member layer 111 does not crack in wire drawing performed when producing the base member 10 through fitting. By forming the first base member layer 111 and the second base member layer 112 before the wire drawing in step S3, the first base member layer 111 and the second base member layer 112 are formed on the comparatively thick core wire 100. Therefore, the first base member layer 111 and the second base member layer 112 that each have a uniform thickness can be easily formed. In particular, if the first base member layer 111 and the second base member layer 112 are formed through plating, the first base member layer 111 and the second base member layer 112 are likely to have a uniform thickness.

Step S2

The base member 10 is heated before the wire drawing in step S3. Although not shown, as a result of heating the base member 10, an intermediate layer that contains Cu, which is the component of the first base member layer 111, and Sn, which is the component of second base member layer 112, is formed between the first base member layer 111 and the second base member layer 112 of the base member 10. The reason therefor is that Cu contained in the first base member layer 111 can be diffused into the second base member layer 112. This intermediate layer can form the above-described first layer 41 (FIG. 1) of the Al base wire 1 after wire drawing.

The base member 10 is heated to a temperature of 50° C. or more, for example. If the base member 10 is heated to a temperature of 50° C. or more, Cu is likely to be diffused. Therefore, the above-described intermediate layer is likely to be formed. The base member 10 is heated to a temperature of 230° C. or less, for example. If the base member 10 is heated to a temperature of 230° C. or less, it is possible to prevent excessive diffusion of Cu. It is also possible to prevent the melting of Sn. Also, because the time for increasing the temperature can be shortened, the productivity of the Al base wire 1 can be improved. The base member 10 may also be heated to a temperature of 80° C. or more and 200° C. or less, and in particular to a temperature of 100° C. or more and 150° C. or less. The holding time period at the heating temperature is 0.2 min or more and 5 min or less, for example. When the holding time period is 0.2 min or more, Cu is likely to be diffused. When the holding time period is 5 min or less, the holding time period can be shortened, and thus the productivity of the Al base wire 1 can be improved. The holding time period may also be 0.5 min or more and 3 min or less, and in particular, 1 min or more and 2 min or less.

Step S3

In wire drawing to be performed on the heated base member 10, the Al base wire 1 having a desired wire diameter is produced. This wire drawing is cold wire drawing. The first base member layer 111 of the base member 10 is cracked due to this wire drawing. Due to the cracking in the first base member layer 111, the above-described coating pieces 3 of the Al base wire 1 are formed. Also, Cu contained in the first base member layer 111 is diffused into the second base member layer 112 due to this wire drawing. Due to the diffusion of Cu, the above-described first layer 41 of the Al base wire 1 is formed. The second base member layer 112 of the base member 10 forms the above-described second layer 42 of the Al base wire 1.

The reason why the first base member layer 111 of the base member 10 cracks is that the ductility of the first base member layer 111 is lower than the ductility of the core wire 100 and the second base member layer 112. Also, the reason why the first base member layer 111 of the base member 10 cracks is that the first base member layer 111 is thin. Even if the first base member layer 111 of the base member 10 cracks and the coating pieces 3 of the Al base wire 1 are formed, the second base member layer 112 of the base member 10 does not crack and the first layer 41 and the second layer 42 of the Al base wire 1 are produced. The reason therefor is that the hard first base member layer 111 is thin, and the soft second base member layer 112 is thick. Also, the coating pieces 3 of the Al base wire 1, which are formed due to the first base member layer 111 of the base member 10 cracking, does not peel off from the core wire 100 or the base layer. This is because the first layer 41 of the Al base wire 1 covers the outer peripheries of the coating pieces 3 of the Al base wire 1, which are formed due to the first base member layer 111 of the base member 10 cracking, and the first layer 41 of the Al base wire 1 enters the region between coating pieces 3.

Typically, a wire drawing process may be performed in multiple passes. If a wire drawing process is performed in multiple passes, the degree of processing per pass and the moving speed of the base member 10 are adjusted as appropriate according to the final wire diameter such that the first base member layer 111 of the base member 10 cracks and the first layer 41 (FIG. 1) is formed.

If a multi-pass wire drawing process is performed, the degree of processing per pass, that is, the reduction in cross-sectional area per pass, is 8% or more. If the degree of processing is 8% or more, the first base member layer 111 of the base member 10 is likely to crack. Also, if the degree of processing is 8% or more, the first layer 41 (FIG. 1) is likely to be formed. The degree of processing is 30% or less. If the degree of processing is 30% or less, breakage of the core wire 100 and damage to the second base member layer 112 can be reduced. Furthermore, the degree of processing may also be 10% or more and 25% or less, and in particular, 12% or more and 20% or less. The degree of processing is {(the transverse cross-sectional area before wire drawing—the transverse cross-sectional area after wire drawing)/the transverse cross-sectional area before wire drawing}×100.

Note that first base member pieces are formed in the form of islands on the outer periphery of the core wire 100 through plating, for example, and the second base member layer 112 is formed on outer peripheries of the first base member pieces and the outer periphery of the core wire 100 between first base member pieces through plating, for example, and step S2 and step S3 that are described above are performed thereon. Accordingly, the coating pieces 3 can be formed, but the first layer 41 with a uniform thickness cannot be formed.

Effects

With the above-described method for manufacturing the Al base wire, it is possible to manufacture the Al base wire 1 whose coating layer 4 is unlikely to crack even if bending is applied thereto.

Test Example 1

An Al base wire was produced, and the state of its coating layer when bending was applied to the Al base wire was examined.

Sample No. 1 to Sample No. 7

The Al base wires of Sample No. 1 to Sample No. 7 were produced through the step of preparing a base member, the step of heating the base member, and the step of performing wire drawing on the heated base member.

Preparation of Base Member

The base member was produced by forming a base layer directly on a core wire, and forming a coating layer directly on the base layer, the coating layer having a two-layer structure of a first base member layer and a second base member layer in the stated order from the base layer side. A pure Al wire with a diameter of 0.5 mm was used as the core wire. The component of the pure Al wire corresponds to A1070 specified in "JIS H 4000 (2014), Aluminum and aluminum alloy sheets, strips and plates".

The base layer was formed in the order of degreasing, etching, desmutting, first zincate treatment, zinc stripping, and second zincate treatment.

SZ CLEANER manufactured by Kizai Corporation was used as treatment liquid in degreasing. "SZ CLEANER" is a product name. The liquid temperature was set to 70° C. The time for immersion in the liquid was set to 90 sec.

SZ ETCHANT manufactured by Kizai Corporation was used as treatment liquid in etching. "SZ ETCHANT" is a product name. The liquid temperature was set to 70° C. The time for immersion in the liquid was set to 90 sec.

An aqueous solution of nitric acid with a concentration of 50 mass % was used as a treatment liquid in desmutting. The liquid temperature was set to 25° C. The time for immersion in the liquid was set to 30 sec.

SZ-II manufactured by Kizai Corporation was used as treatment liquid in first zincate treatment. "SZ-II" is a product name. The liquid temperature was set to 20° C. The time for immersion in the liquid was set to 60 sec.

Zinc stripping was performed using the same treatment liquid under the same conditions as in desmutting.

Second zinc stripping was performed using the same treatment liquid under the same conditions as in the first zincate treatment.

The first base member layer and the second base member layer were each formed through plating.

A Cu plating layer was formed as the first base member layer through electroplating. This Cu plating layer was formed directly on the base layer, over the entire outer periphery of the base layer. A copper pyrophosphate plating liquid was used as a plating liquid. The liquid temperature was set to 45° C. The time for immersion in the liquid was set to 150 sec. The current density was changed in various ways. The thicknesses (μm) of the first base member layers in the base members of Sample No. 1 to Sample No. 7 were changed according to the current density.

A Sn plating layer was formed as the second base member layer through electroplating. The Sn plating layer was formed directly on the first base member layer, over the entire outer periphery of the first base member layer. A liquid containing stannous sulfate (40 g/L), potassium pyrophosphate (165 g/L), polyethylene glycol (1 g/L) with an average molecular weight of 3000, and 37-mass % formaldehyde (0.6 mL/L) was used as a plating liquid. The liquid temperature was set to 40° C. The time for immersion of the base member in the liquid was set to 160 sec.

The thicknesses of the first base member layers and the thicknesses of the second base member layers in the obtained base members were each obtained. The thickness of each base member layer was obtained through cross-sectional observation using a SEM (scanning electron microscope).

The thicknesses of the base member layers were measured as follows. First, a longitudinal section of the base member was obtained. Three observation fields were obtained on the longitudinal section of the base member. In a method for obtaining each observation field in a case where the thickness of the first base member layer is obtained, the boundary between the first base member layer and the base layer and the boundary between the first base member layer and the second base member layer are included therein. In a method for obtaining each observation field in a case where the thickness of the second base member layer is obtained, the boundary between the second base member layer and the first base member layer and the outer peripheral surface of the second base member layer are included therein. The magnification of each observation field was 1000. The size of each observation field was 12.5 μm×10 μm. The length of the layers in each observation field along the radial direction of the core wire was measured at five or more positions. The average of the measured lengths of the first base member layer and the average of the measured lengths of the second base member layer were obtained. The averages were used as the thicknesses of the corresponding base member layers. The thicknesses of the first base member layers in the base members of Sample No. 1 to Sample No. 7 are shown in Tables 1 and 2. The thicknesses of the second base member layers in the base members of Sample No. 1 to Sample No. 7 were all 12 μm.

Heating of Base Member

The base members were heated such that the temperature of the base members reached 200° C. The holding time period during the heating time was set to 0.5 min, that is, 30 sec. When the heating time has passed, the temperature of the base members to be subjected to wire drawing was set to normal temperature.

Wire Drawing

Wire drawing was performed under the following conditions such that the final wire diameter was 0.3 mm. The number of passes was five. The degree of processing per pass was set to 15%.

Cross-sections of the obtained Al base wires were observed using a SEM. As a result, the Al base wires of Sample No. 1 to Sample No. 5 were each provided with multiple coating pieces directly on the base layer such that the multiple coating pieces were scattered thereon. Also, the Al base wires of Sample No. 1 to Sample No. 5 were each provided with the first layer that continuously covers regions directly above the base layer between adjacent coating pieces and regions directly above the coating pieces. Furthermore, the Al base wires of Sample No. 1 to Sample No. 5 were each provided with the second layer covering the entire outer periphery of the first layer directly on the first layer. The components of the coating pieces, the first layer, and the second layer were analyzed using ICP-OES. iCAP6500 manufactured by Thermo Fisher Scientific was used in ICP-OES. As a result, the coating pieces were composed of Cu. The first layer was composed of substantially Cu and Sn. The second layer was composed of Sn. Also, the thickness (μm) and the width (μm) of the coating pieces, the distances between coating pieces that were adjacent to each other along the longitudinal direction of the core wires, the area α of the coating pieces, the area β of the first layer, and the thickness (μm) of the second layer were measured using the above-described measurement methods. The results thereof are shown in Table 1.

On the other hand, unlike the Al base wire of Sample No. 1 and the like, the Al base wires of Sample No. 6 and Sample No. 7 were not provided with multiple coating pieces directly on the base layers. The Al base wires of Sample No. 6 and Sample No. 7 were each provided with a coating layer directly on the base layer, the coating layer having a three-layer structure of the first layer, the second layer, and the third layer in the stated order from the base layer side. Each layer was provided directly on a layer inward of the layer, over the entire outer periphery of the layer inward of the layer. Similarly to the manner for the Al base wire of Sample No. 1 and the like, the components of the first layers, the second layers, and the third layers in the Al base wires of Sample No. 6 and Sample No. 7 were analyzed. As a result, the first layer was composed of substantially Cu. The second layer was composed of substantially Cu and Sn. The third layer was composed of substantially Sn. Also, the thicknesses (μm) of the first layer to the third layer were measured. The results thereof are shown in Table 2. A method for measuring the thickness of each layer was the same as the method for measuring the thicknesses of the first layer and the second layer in the Al base wire of Sample No. 1.

Bending Test

Self-diameter bending in which the Al base wire of each sample was wound around a bar member having the same diameter as the Al base wire of the sample was performed as a bending test. The presence or absence of cracks in and peeling of the coating layers of the Al base wires of the samples on which the bending test was performed were observed using an optical microscope, and the states of the coating layers were evaluated. The states of the coating layers were evaluated in three criteria "A", "B", and "C". A sample where no crack or peeling occurred in the coating layer was evaluated as "A". A sample where a small number of cracks occurred in the coating layer was evaluated as "B". A sample where a large number of cracks occurred in the coating layer was evaluated as "C". A "small number of cracks" means that the exposure of Al was not visually identified even if the surface of the coating layer was enlarged using a SEM at a magnification of 200, and Al was detected through EDX by enlarging the surface of the coating layer using the SEM at a magnification of 2000. Miniscope TM3030Plus manufactured by Hitachi High-Technologies Corporation was used as the SEM. Quantax70 manufactured by Hitachi High-Technologies Corporation was used in EDX. A "large number of cracks" means that the exposure of Al was visually identified when the surface of the coating layer was enlarged using a SEM at a magnification of 200. The results thereof are shown in Tables 1 and 2.

TABLE 1

| | Base member (before wire drawing) | Al base wire (after wire drawing) | | | | | | | | | | |
|---|---|---|---|---|---|---|---|---|---|---|---|---|
| | Coating layer | | | | | | | Coating layer | | | | |
| | First base member layer | Coating piece | | | | | Area | First layer | | Second layer | | |
| Sample No. | Thickness (μm) | Presence | Composition | Thickness (μm) | Width (μm) | Distance (μm) | ratio α:β | Composition | Thickness (μm) | Composition | Thickness (μm) | Evaluation of bending |
| 1 | 0.1 | yes | Cu | 0.06 | 0.2 | 10 | 1:55 | Cu and Sn | 0.2 | Sn | 3.6 | A |
| 2 | 0.3 | yes | Cu | 0.18 | 1.6 | 6 | 1:15 | Cu and Sn | 0.5 | Sn | 3.3 | A |

TABLE 1-continued

| | Base member (before wire drawing) | Al base wire (after wire drawing) | | | | | | | | | | |
|---|---|---|---|---|---|---|---|---|---|---|---|---|
| | Coating layer | | | | | | | Coating layer | | | | |
| | First base member layer | Coating piece | | | | | Area | First layer | | Second layer | | |
| Sample No. | Thickness (μm) | Presence | Composition | Thickness (μm) | Width (μm) | Distance (μm) | ratio α:β | Composition | Thickness (μm) | Composition | Thickness (μm) | Evaluation of bending |
| 3 | 0.5 | yes | Cu | 0.3 | 4.2 | 5 | 1:10 | Cu and Sn | 0.8 | Sn | 3.8 | A |
| 4 | 1.0 | yes | Cu | 0.6 | 5.7 | 3 | 1:3 | Cu and Sn | 1.5 | Sn | 3.2 | A |
| 5 | 1.5 | yes | Cu | 0.9 | 5.5 | 1 | 1:2 | Cu and Sn | 1.6 | Sn | 3.9 | A |

TABLE 2

| | Base member (before wire drawing) | Al base wire (after wire drawing) | | | | | | | | |
|---|---|---|---|---|---|---|---|---|---|---|
| | Coating layer | Coating | Coating layer | | | | | | | |
| | First base member layer | piece | First layer | | Second layer | | Third layer | | | |
| Sample No. | Thickness (μm) | Presence | Composition | Thickness (μm) | Composition | Thickness (μm) | Composition | Thickness (μm) | Evaluation of bending |
| 6 | 2.1 | no | Cu | 1.2 | Cu and Sn | 2.2 | Sn | 3.9 | B |
| 7 | 4 | no | Cu | 2.4 | Cu and Sn | 3.5 | Sn | 4.1 | C |

As shown in FIG. 1, with the Al base wires of Sample No. 1 to Sample No. 5, no cracks occurred in the coating layers and the coating layers did not peel off even if bending was applied thereto. On the other hand, as shown in FIG. 2, with the Al base wires of Sample No. 6 and Sample No. 7, cracks occurred in the coating layers due to bending being applied thereto.

The present invention is defined by the terms of the claims, but not limited to the above description, and is intended to include any modifications within the meaning and scope equivalent to the terms of the claims.

LIST OF REFERENCE NUMERALS

1 Al base wire
2 Core wire
3 Coating piece
4 Coating layer
41 First layer
42 Second layer
10 Base member
100 Core wire
110 Coating layer
111 First base member layer
112 Second base member layer

The invention claimed is:

1. An aluminum base wire comprising:

a core wire composed of pure aluminum or an aluminum alloy;

a plurality of coating pieces provided so as to be scattered on an outer periphery of the core wire; and a coating layer provided on the outer periphery of the core wire and an outer periphery of each of the plurality of coating pieces;

wherein the coating layer includes a first layer that is provided continuously on the outer periphery of the core wire between adjacent coating pieces and the outer periphery of each of the plurality of coating pieces; and a second layer provided on an outer periphery of the first layer, the plurality of coating pieces are each composed of copper or a copper alloy, the first layer is composed of metals that include copper and tin, and the second layer is composed of tin or a tin alloy.

2. The aluminum base wire according to claim 1, wherein the coating pieces have a thickness of 1.5 μm or less.

3. The aluminum base wire according to claim 1, wherein the coating pieces have a width of 20 μm or less.

4. The aluminum base wire according to claim 1, wherein a distance between the coating pieces that are adjacent to each other in a longitudinal direction of the core wire is 0.5 μm or more.

5. The aluminum base wire according to claim 1, wherein the first layer has a thickness of 0.1 μm or more and 3 μm or less.

6. The aluminum base wire according to claim 1, an area ratio α:β between an area α of the coating pieces on a cross-section extending along a longitudinal direction of the core wire and an area β of the first layer is 1:1 or more and 1:120 or less.

7. The aluminum base wire according to claim 1, wherein the aluminum base wire has a diameter of 0.01 mm or more and 0.6 mm or less.

8. A stranded wire obtained by twisting a plurality of the aluminum base wires according to claim 1 together.

9. A method for manufacturing an aluminum base wire, comprising: a step of preparing a base member provided with a core wire composed of pure aluminum or an aluminum alloy; and a coating layer provided on an outer periphery of the core wire; a step of heating the base member; and a step of performing wire drawing on the base member that was heated; wherein the coating layer includes a first base member layer provided on the outer periphery of the core wire, and a second base member layer provided on an outer periphery of the first base member layer, the first base member layer is composed of copper or a copper alloy, the first base member layer has a thickness of 2 um or less, the second base member layer is composed of tin or a tin alloy, and the first base member layer is cracked as a result of the wire drawing step to form a plurality of coating pieces provided so as to be scattered on the outer periphery of the core wire.

* * * * *